US007918969B2

(12) United States Patent
McPherson

(10) Patent No.: US 7,918,969 B2
(45) Date of Patent: Apr. 5, 2011

(54) COMPOSITE CONSTRUCTION FOR DEWATERING BLADES FOR A PAPERMAKING MACHINE

(75) Inventor: Douglas R. McPherson, East Granby, CT (US)

(73) Assignee: AstenJohnson, Inc., Charleston, SC (US)

( * ) Notice: Subject to any disclaimer, the term of this patent is extended or adjusted under 35 U.S.C. 154(b) by 788 days.

(21) Appl. No.: 11/690,479

(22) Filed: Mar. 23, 2007

(65) Prior Publication Data

US 2008/0230197 A1 Sep. 25, 2008

(51) Int. Cl.
*D21F 1/44* (2006.01)

(52) U.S. Cl. ..... 162/312; 162/199; 162/374

(58) Field of Classification Search ..... 162/312, 162/199, 374, 352
See application file for complete search history.

(56) References Cited

U.S. PATENT DOCUMENTS

| | | | | |
|---|---|---|---|---|
| 3,337,394 | A | 8/1967 | White et al. | |
| 3,446,702 | A | 5/1969 | Buchanan | |
| 3,732,142 | A * | 5/1973 | Beacom et al. | 162/374 |
| 3,778,342 | A | 12/1973 | Charbonneau | |
| 3,871,953 | A | 3/1975 | Lee et al. | |
| 3,874,998 | A | 4/1975 | Johnson | |
| 3,884,757 | A | 5/1975 | Beacom et al. | |
| 3,928,125 | A * | 12/1975 | Poeschl | 162/352 |
| RE29,417 | E | 9/1977 | Lee et al. | |
| 4,238,286 | A * | 12/1980 | Poeschl | 162/352 |
| 4,334,958 | A * | 6/1982 | Baluha et al. | 162/352 |
| 4,420,370 | A | 12/1983 | Saad | |
| 4,425,189 | A * | 1/1984 | Mimura | 162/352 |
| 5,076,894 | A | 12/1991 | Simmons et al. | |
| 5,630,910 | A | 5/1997 | McPherson | |
| 2003/0173048 | A1 | 9/2003 | Buchanan et al. | |

* cited by examiner

*Primary Examiner* — Mark Halpern
(74) *Attorney, Agent, or Firm* — Volpe and Koenig, P.C.

(57) ABSTRACT

Dewatering blades for use in papermaking machines are assembled from two or more pre-finished sub-assemblies which are in turn mounted on a base member. Each sub-assembly comprises a holder, configured to receive a plurality of segments, constructed of a wear-resistant material such as ceramic, which will be located so as to be in sliding contact with the underside of a papermaking fabric. The holders are adapted for insertion into and retention in the base member, which is subsequently affixed to the papermaking machine by known means. The construction of the sub-assemblies allows for the manufacture of a full length blade from a plurality of sub-assemblies, which dramatically reduces manufacturing cost while providing for more rapid deliveries and simplified repair of damaged blades.

16 Claims, 3 Drawing Sheets

COMPOSITE CONSTRUCTION FOR DEWATERING BLADES FOR A PAPERMAKING MACHINE

FIELD OF THE INVENTION

The present invention relates to dewatering blades, which are intended for use in a papermaking machine or similar filtration application, and methods for their assembly. It is specifically concerned with such blades which are comprised of a plurality of sub-assemblies, including segments of wear-resistant material such as ceramics.

BACKGROUND OF THE INVENTION

In the manufacture of paper, a very dilute slurry of about 99% water and 1% papermaking fibers is ejected at very high speed and precision from a headbox onto a moving forming fabric. The slurry is rapidly dewatered through the fabric to a consistency of roughly 25% fiber as it proceeds downstream through the forming section and then to about 45% fiber as it passes through the press section of the papermaking machine. The forming section is often referred to as the "wet end" of the papermaking machine because of the relatively large volume of water that must be removed from the embryonic web and managed during the papermaking process. Means for doing this are well known and consist, in modern papermaking machines, of blades or foils which are mounted on the covers of dewatering boxes located opposite the sheet, or on felt cleaning or steam heating boxes in the press section. The surfaces of these blades (known variously in the industry as foil blades, foils, forming board blades, uhle box blades, dewatering blades, lovac blades, suction box blades and deflector blades, henceforth referred to simply as "blades") are in constant sliding contact with the papermaking fabrics transporting the web. The wear surfaces of these blades are typically made from a ceramic material so as to resist for as long as possible the abrasive wear caused by factors including the constant movement of the fabrics, and abrasive substances in the slurry.

Ceramic covered blades as used in the papermaking industry are currently manufactured using one of two techniques. The first is to bond individual ceramic segments (usually 0.5" to 3" [1.2-7.5 cm] long) into a full length fiberglass support base (full length meaning the base extends across the full width of the paper machine for which it is intended) and then to precision grind this ceramic assembly to a finished condition. The second technique is to finish grind the individual ceramic segments first, and then mount them into an accurately machined base that can be made of fiberglass or polyethylene, the choice of which will depend on the end use and customer preference. In both cases, the blade is produced as a full length product. It will be appreciated that this can be a very time consuming, expensive and laborious process as these full length blades must be made to a length sufficient to span the width of a modern papermaking machine; such machines may have widths as great as 400 inches (10.2 m) or more.

Currently, in order to repair a bonded style blade (where individual ceramic segments are bonded directly onto the full length base), the only solution is to heat the ceramic segments in order to destroy the adhesive bond between base and segment, and then remove the damaged segments. This frequently results in damaging additional segments adjacent to the intended repair site. After the damaged segments are removed, replacement segments are then bonded back in the original location. These replacement segments then have to be hand ground to correspond as accurately as possible with the configuration of the existing segments. Frequently, re-bonding is not as durable as the original bond, increasing the potential for future failure.

DISCUSSION OF THE PRIOR ART

Blades intended for use in papermaking, methods for their mounting and their assembly are well known in the papermaking arts and the patent literature is replete with descriptions of various types. See for example, U.S. Pat. No. 3,337,394 (White et al.); U.S. Pat. No. 3,446,702 (Buchanan); U.S. Pat. No. 3,732,142 (Beacom et al.); U.S. Pat. No. 3,778,342 (Charbonneau); U.S. Pat. No. 3,871,953 (Lee et al.); U.S. Pat. No. 3,874,998 (Johnson); U.S. Pat. No. 3,884,757 (Beacom et al.); U.S. Pat. No. 4,420,370 (Saad); U.S. Pat. No. 5,076,894 (Simmons et al.); U.S. Pat. No. 5,630,910 (McPherson); many others are known and used.

SUMMARY OF THE INVENTION

The present invention is directed to a blade for use in a papermaking machine, or similar filtration application, and in particular with a blade and a method of manufacturing a blade wherein the finished blade is assembled from a plurality of components, which are standardized sub-assemblies, which are in turn mounted onto a base unit having a length sufficient to span the width of the papermaking machine for which it is intended.

The use of sub-assemblies, each having a small number of segments, secured to holders which can in turn be secured to a standard base to provide a blade of the desired dimensions, provides numerous advantages. Firstly, they provide for a significantly simplified assembly in accurate alignment, and each sub-assembly is readily replaceable in the event of damage, particularly as the configuration of the holders can be standardized. Secondly, by reason of the smaller size as compared with a full size blade, the sub-assemblies can be constructed in smaller locations, and are readily transportable with substantially reduced risk of damage. Thirdly, the segments can be finished to a desired upper surface profile either before or after being secured to the holders, or after the holders are secured to the base unit.

In a first broad embodiment, the invention therefore seeks to provide a sub-assembly for assembly in a plurality in a blade for a papermaking machine, the blade having a base with an upper surface, a lower machine-contacting surface and two lateral edges, the sub-assembly having first and second lateral edges and comprising (i) a holder securable to the upper surface of the base and comprising first and second side surfaces having compatibly inverse configurations; and (ii) a plurality of segments, each having a fabric-contacting upper surface, a holder-contacting lower surface, a leading edge and a trailing edge, and first and second side surfaces, each having a preselected profile, wherein (a) for each segment, in a direction from the leading edge to the trailing edge, the profile of each first side surface has a compatibly inverse configuration to the profile of each second side surface;

(b) the holder is constructed and arranged to receive and securely retain the segments in an abutting relationship of the respective side surfaces of the segments;

(c) when the plurality of sub-assemblies is assembled in the blade, exposed outer side surfaces of first and last segments in adjacent sub-assemblies are retained in an abutting relationship; and (d) the sub-assemblies are constructed and arranged to be secured to the base in an aligned abutting relationship, and securely retained therein by a retaining means.

In a second broad embodiment, the invention further seeks to provide a blade for a papermaking machine comprising a base and a plurality of the sub-assemblies.

In a third broad embodiment, the invention further seeks to provide a method of manufacturing a blade for a papermaking machine, the method comprising:

(i) providing a plurality of sets of segments, each segment having an upper surface and a pair of opposing side surfaces having compatibly inverse configurations;

(ii) providing a plurality of holders having side surfaces comprising compatibly inverse configurations;

(iii) mounting and securely attaching in each holder one of the sets of the segments in an abutting relationship of the side surfaces of the segments;

(iv) providing a base;

(v) securing the holders to the base in an abutting relationship of the side surfaces of the holders; and (vi) providing a retaining means to retain the adjacent holders and the segments within each set and between adjacent holders in a closely abutting relationship.

BRIEF DESCRIPTION OF THE DRAWINGS

The invention will now be described with reference to the drawings, in which.

DETAILED DESCRIPTION OF THE DRAWINGS

Figure 1:
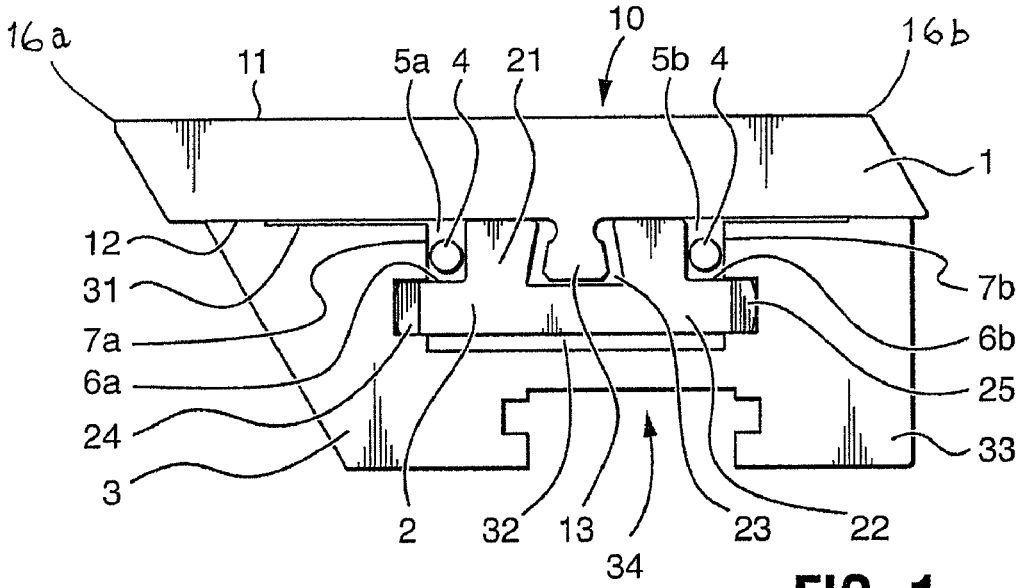
FIG. 1 is a cross-sectional view of a sub-assembly of a first embodiment of the invention mounted on a base.

Referring to FIG. 1, a sub-assembly 10 includes a segment 1 comprising an upper fabric-contacting portion 11, a lower surface 12 and a protruding lower portion 13. Holder 2 comprises an upper portion 21 defining an indented region such as slot 23, and a lower portion 22, with extended side members 24, 25. The lower portion 13 of segment 1 is receivable in the slot 23, and can be secured therein by known means such as an adhesive. A base 3 has an aperture 32 in its upper surface 31, in which the lower portion 22 of the holder 2 can be received and secured, In the lower surface 33 of the base 3, a suitable aperture 34 is provided, which allows for the installation of the base 3 with a plurality of sub-assemblies 10 to the papermaking machine (not shown).

Alternatively, the holder 2 can be provided with a substantially flat surface to the upper portion 21, i.e. omitting slot 23, to which segments 1, when provided with substantially flat lower surfaces 12, can be affixed directly, for example by an adhesive.

In this embodiment, the sub-assemblies 10 are secured together in the base 3 on the papermaking machine by a longitudinal retaining means such as rod, wire or cable, shown in FIG. 1 as a pair of rods 4, inserted through the longitudinal apertures 5*a*, 5*b* which are defined by outer surfaces 6*a*, 6*b* of the holder 2 and inner surfaces 7*a*, 7*b* of the base 3. A tensioning mechanism is generally necessary to overcome any effects of differential thermal expansion induced in the various materials comprising the blade base and ceramic sub-assemblies.

Figure 2:
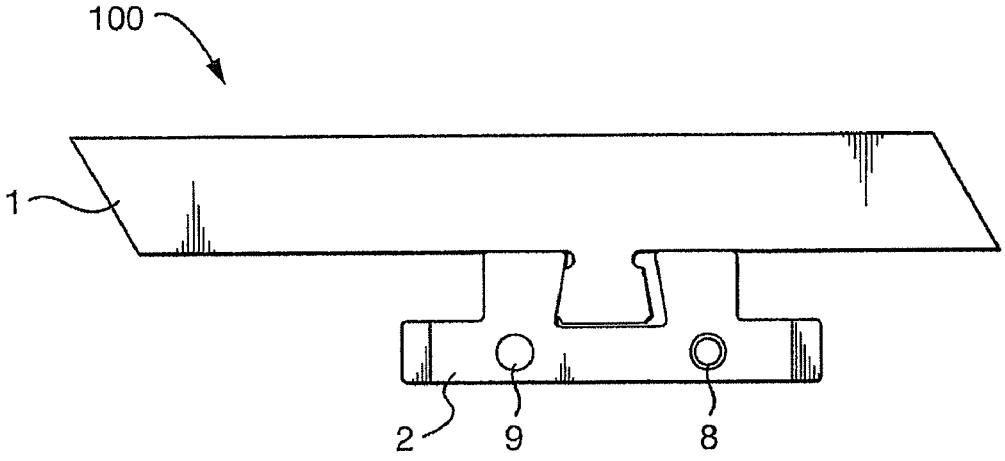
FIG. 2 is an end-view of a sub-assembly of a second embodiment of the invention.

In FIG. 2, an alternative embodiment of the sub-assembly 100 is shown in end view. In this embodiment, the segments 1 can be secured within the holder 2 in the same manner as in the embodiment of FIG. 1. However, each holder 2 can be secured to an adjacent holder by a connecting means provided to each end of the holders. In the holder shown in this figure, a pin 8 and socket 9 can be connected respectively to a socket 9 and pin 8 on an adjacent holder 2.

Figure 3:
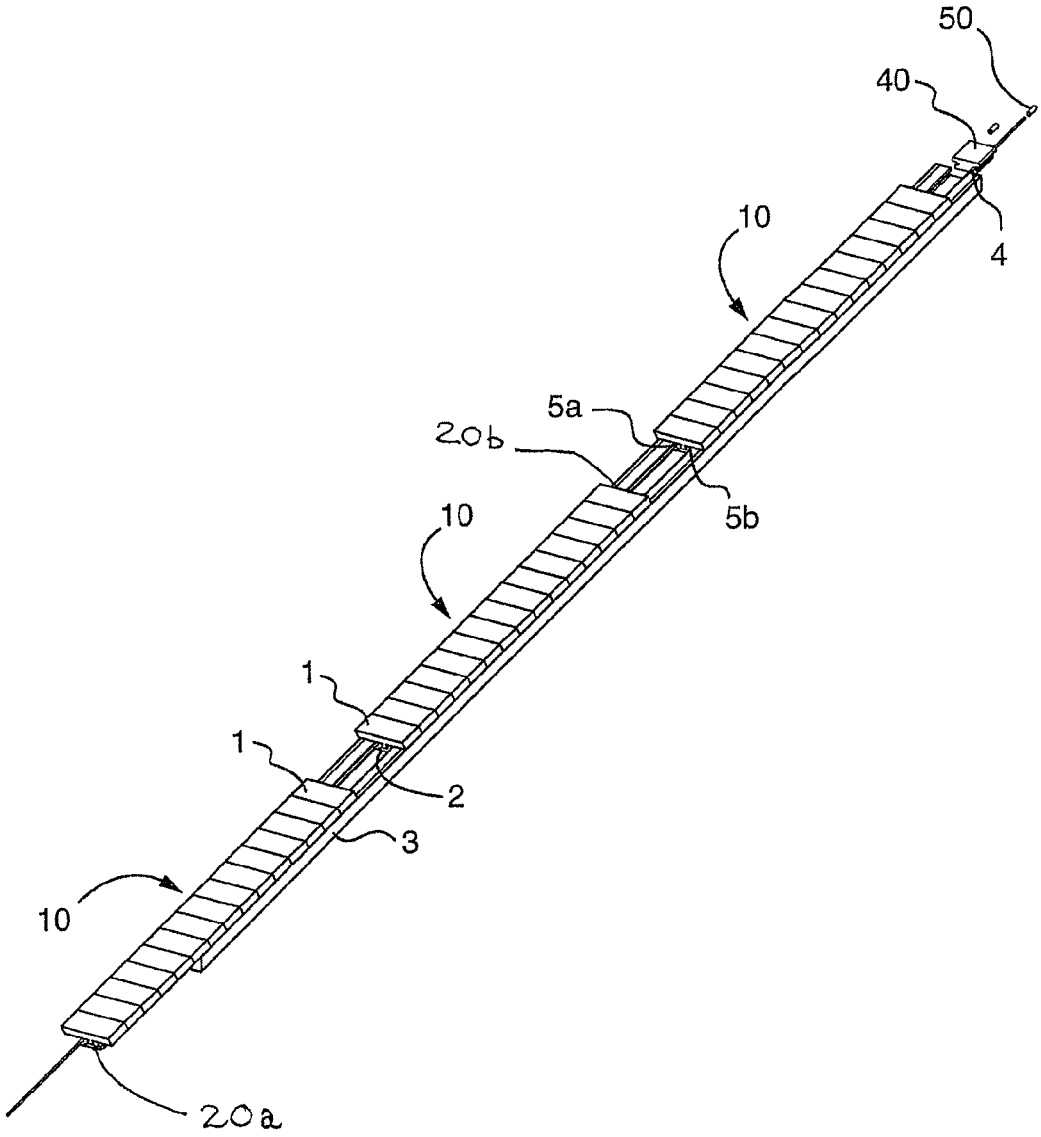
FIG. 3 is an exploded perspective view of three sub-assemblies of the invention on a base.

Referring to FIG. 3, three sub-assemblies 10 as in FIG. 1 are shown partially mounted on a base 3, the holders 2 being slid onto the base 3. When all the desired holders 2 are on the base 3, the end segments 1 of each adjacent holder 2 will abut each other, and rods 4 can be inserted into apertures 5*a*, 5*b* in each of the holders 2, and each of the two end blocks 40, which are then tightly secured by known securing means such as threaded fasteners 50.

Figure 4:
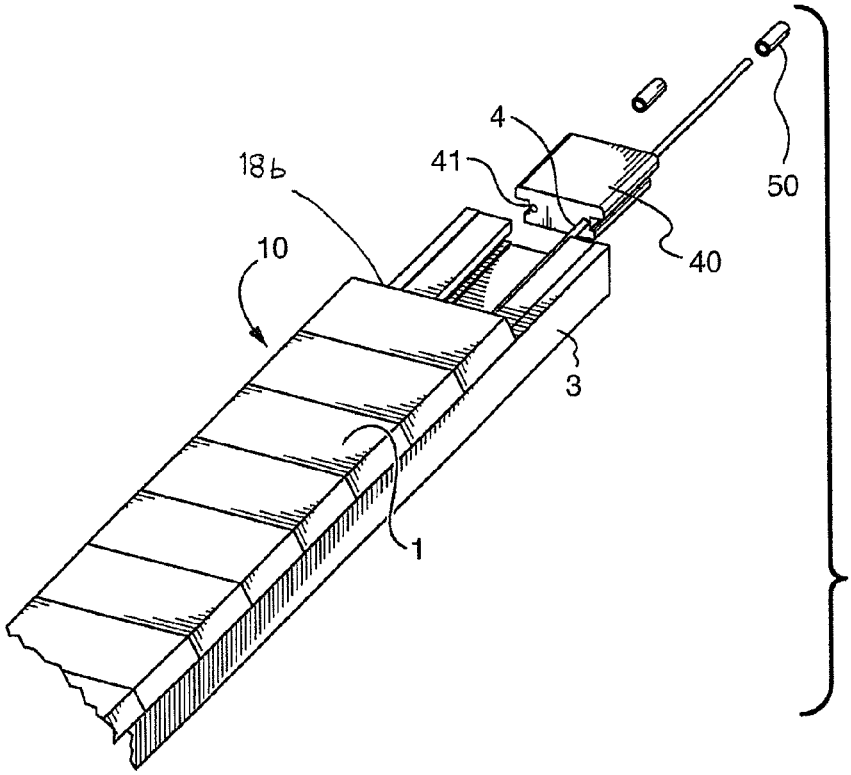
FIG. 4 is a perspective view of a sub-assembly of FIG. 1 showing an end block attachment.

FIG. 4 shows an end of a sub-assembly 10 of the embodiment of FIG. 1, partially mounted on a base 3. In this figure, a first rod 4 is shown inserted through the holder 2 and end block 40, to be secured by threaded fastener 50. A second rod 40 will be inserted through holder 2 and into the aperture 41 shown in end block 40.

Figure 5:
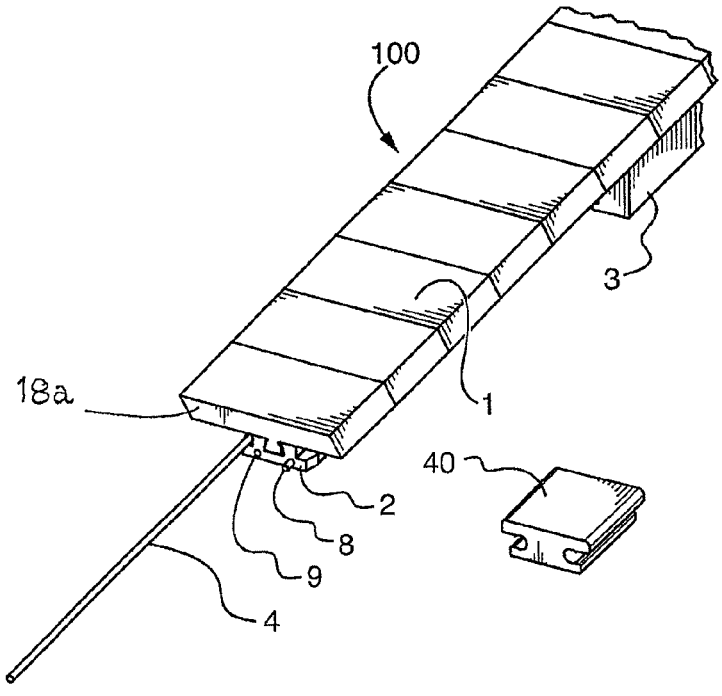
FIG. 5 is a perspective view of a sub-assembly of FIG. 2 showing an end block attachment.

FIG. 5 shows one end of a sub-assembly 100 of the embodiment of FIG. 2, partially mounted on a base 3. The pin 8 and socket 9 can be seen at the end of the holder 2, and a first rod 4, before mounting of the end block 40.

As noted above, the usual material for the segments 1 used in these types of blade is ceramic, but the sub-assemblies of the invention are suitable for use with any wear-resistant material. The upper profile of the segments from the leading edge 16*a* to the trailing edge 16*b*, and, which is shown as substantially planar in the figures, can be of any configuration depending on the intended end use of the blade. Such profiles can be imparted by grinding each individual segment 1 prior to installation in the holder 2, or subsequently, after installation into the holders 2. Alternatively, the surface profile can be provided after the segments 1 have been mounted to the base 3 and secured by the retaining means.

The side surfaces of the segments 1 are shown in the drawings as being substantially planar. However, any configuration can be used which is suitable for the materials selected and the intended end use of the blade, for example a curved or angular profile, provided that the first side surface 18*a* of each segment has a compatibly inverse configuration with the second side surface 18*b*, so that when two segments 1 are secured together in a holder 2, adjacent abutting side surfaces 18*a*, 18*b* are in maximum contact; and when adjacent holders 2 are brought together in the base 3, the end segments 1 of each adjacent holder are in maximum contact.

Similarly, the holders 2 can have various configurations, but a tightly toleranced tee shape has been found to be suitable. Their side surfaces can also have any suitable configuration, provided that the first side surfaces 20*a* have compatibly inverse configurations to the second side surfaces 20*b*, and are at the same time compatible with the side surfaces of the segments 1 intended to be retained in the holders 2. Where the holders 2 are provided with a slot 23 to receive the segments 1, it is generally preferable to provide a dimensionally tight fight to accommodate and tightly hold the segments 1 in place securely, with the optional addition of an adhesive.

Where the segments 1 are constructed of ceramic material, the holders 2 are preferably constructed of fiberglass because it is strong, and has thermal expansion characteristics similar to ceramic. However, other materials can be used, including polyethylene, and metal. As the holders 2 are relatively short from one side to the other, any difference in the coefficient of thermal expansion of some metals and of the segments may not have a significant effect, so that metals can be used which would not be suitable for the much larger holders of the prior art which extend across the entire width of the blades.

We have found that epoxy is a suitable adhesive with which to bond the segments 1 securely in place to the holders 2, but other adhesives may be used. If the segments 1 are not already pre-ground to the desired profile, they can be precision ground after the epoxy or other adhesive has cured. The completed [stock or pre-finished] sub-assemblies 10 may suitably have a length of approximately 25 to 30 inches (63.5 cm to 76.2 cm), although any length that is practical for the intended end use is possible. The sub-assemblies 10 of the invention can be used for any suitable segment size such as known and used in the prior art, in particular the standard sizes for ceramic segments comprising widths between ⅞" (2.1 cm) and 2" (5 cm). A standard locating device (not shown) can be used to align the individual sub-assemblies 10 for both assembly and grinding.

A further advantage of the sub-assemblies 10 of the invention is that it is much more economical to grind the segments 1 when mounted onto the holders 2 in relatively short sub-assemblies, than it is to grind individual segments 1 or a full length blade which has been constructed by the methods of the prior art. An inventory of sub-assemblies 10 can be manufactured in this manner to be placed into stock awaiting an order for a completed blade or set of blades.

The base 3 can be made out of any appropriate material, but a particularly suitable material for the practice of the invention is polyethylene. The advantage of using this material instead of the more common fiberglass of the prior art is the material cost savings and the ease of machining. The base can be readily cut to the profile required for the particular type and application of the blade ordered by the customer, and provided with a mounting slot or profile to correspond with the configuration of the sub-assembly 10. In the drawings, this is shown as a tee slot, but other suitable configurations can be used, and standardized to accommodate the sub-assemblies 10.

In addition to manufacturing savings, the sub-assemblies 10 of the present invention also significantly reduce the cost of blade and/or segment surface repairs. The novel design and assembly of the present invention allows for a sub-assembly 10 containing one or more damaged segments 1 to be removed from the base 3. The adjacent sub-assemblies 10 can be slid back into place and the replacement sub-assembly 10 can be slid in on the end thus minimizing the blending work that needs to be done. In addition, the replacement sub-assembly 10 is structurally as solid as the original construction.

The invention claimed is:

1. A sub-assembly for a blade for a papermaking machine, the blade having a base adapted to receive a plurality of sub-assemblies, the base having an upper surface, a machine-contacting lower surface and two lateral edges, the sub-assembly having first and second lateral edges and comprising (i) a holder comprising an upper portion, a lower portion, and first and second side surfaces having compatibly inverse configurations; and (ii) a plurality of segments, secured to the upper portion of the holder, each segment having a fabric-contacting upper surface, a holder-contacting lower surface, a leading edge and a trailing edge, and first and second side surfaces each having a preselected profile, such that in a direction from the leading edge to the trailing edge, the profile of each first side surface has a compatibly inverse configuration to the profile of each second side surface; wherein the holder is adapted to be releasably securable at the lower region to the base by a retaining means, in an abutting relation with adjacent ones of the plurality of sub-assemblies, such that the sub-assembly is selectively removable from the base independently of the adjacent sub-assemblies.

2. A sub-assembly as claimed in claim 1, wherein the sub-assembly is provided with at least one aperture from the first lateral edge extending through to the second lateral edge and constructed and arranged to longitudinally receive the retaining means.

3. A sub-assembly as claimed in claim 2, wherein the aperture comprises aligned apertures provided through each segment.

4. A sub-assembly as claimed in claim 2, wherein the aperture comprises a pair of substantially parallel apertures provided through each holder.

5. A sub-assembly as claimed in claim 2, wherein the aperture comprises a pair of substantially parallel apertures provided between and defined by selected surfaces of the holder and the base.

6. A sub-assembly as claimed in claim 2, wherein the retaining means is selected from a rod, a wire and a cable, and is constructed and arranged to be inserted through the apertures of each of the plurality of sub-assemblies and securable proximate the lateral edges of the blade.

7. A sub-assembly as claimed in claim 1, wherein the segments are constructed of a ceramic material.

8. A sub-assembly as claimed in claim 1, wherein the holder has a substantially planar upper surface, and the lower surface of each segment is substantially planar and is constructed and arranged to be affixed to the upper surface of the holder with an adhesive.

9. A sub-assembly as claimed in claim 1, wherein the holder has an upper surface having a longitudinal slot constructed and arranged to receive and securely retain at least the lower surface of each segment in the sub-assembly.

10. A sub-assembly as claimed in claim 1, wherein the base is provided with a longitudinal slot constructed and arranged to slidingly receive and retain the plurality of sub-assemblies.

11. A sub-assembly as claimed in claim 1, wherein the upper surface of each segment is provided with a preselected profile before being secured to the holder.

12. A sub-assembly as claimed in claim 1, wherein the upper surface of each segment is provided with a preselected profile after being secured to the holder.

13. A sub-assembly as claimed in claim 1, wherein the holder is constructed of a material selected from fibreglass, polyethylene and metal.

14. A blade for a papermaking machine comprising:

(i) a base; and (ii) a plurality of sub-assemblies according to claim 1.

15. A blade for a papermaking machine according to claim 14, wherein the blade is for use in a forming section.

16. A blade for a papermaking machine according to claim 14, wherein the blade is for use in a press section.

* * * * *